US011066865B2

(12) United States Patent
Hall et al.

(10) Patent No.: US 11,066,865 B2
(45) Date of Patent: Jul. 20, 2021

(54) AUTOMATED SLIDING WINDOW MECHANISM WITH AIR PRESSURE SENSOR

(71) Applicant: Hall Labs LLC, Provo, UT (US)

(72) Inventors: David R. Hall, Provo, UT (US); Emily Brimhall, Alpine, UT (US); Austin Carlson, Provo, UT (US); Jerome Miles, Spanish Fork, UT (US)

(73) Assignee: Hall Labs LLC, Provo, UT (US)

( * ) Notice: Subject to any disclaimer, the term of this patent is extended or adjusted under 35 U.S.C. 154(b) by 0 days.

(21) Appl. No.: 16/153,130

(22) Filed: Oct. 5, 2018

(65) Prior Publication Data

US 2019/0040671 A1 Feb. 7, 2019

Related U.S. Application Data

(63) Continuation-in-part of application No. 15/945,935, filed on Apr. 5, 2018, now Pat. No. 10,718,150, which is a continuation-in-part of application No. 15/867,431, filed on Jan. 10, 2018, now Pat. No. 10,995,537, which is a continuation-in-part of application No. 15/822,394, filed on Nov. 27, 2017, now Pat. No. 10,822,857.

(60) Provisional application No. 62/528,288, filed on Jul. 3, 2017.

(51) Int. Cl.

| | |
|---|---|
| ***E05F 15/71*** | (2015.01) |
| ***E05F 15/632*** | (2015.01) |
| ***E05F 15/77*** | (2015.01) |
| ***E05F 15/79*** | (2015.01) |
| *E05F 15/665* | (2015.01) |

(52) U.S. Cl.

CPC ..... *E05F 15/71* (2015.01); *E05F 15/77* (2015.01); *E05F 15/79* (2015.01); *E05F 15/632* (2015.01); *E05F 15/665* (2015.01)

(58) Field of Classification Search

CPC . E05F 15/71; E05F 15/70; E05F 15/79; E05F 15/77; E05F 15/632; E05F 1/004

See application file for complete search history.

(56) References Cited

U.S. PATENT DOCUMENTS

| | | | | |
|---|---|---|---|---|
| 5,006,766 A * | 4/1991 | Yuhas | ..... | E05F 15/619 318/53 |
| 5,226,256 A * | 7/1993 | Fries | ..... | E05B 47/0012 49/13 |
| 5,449,987 A * | 9/1995 | McMillan | ..... | G05B 19/042 318/266 |

(Continued)

*Primary Examiner* — Justin B Rephann

(57) ABSTRACT

An automated sliding window mechanism is disclosed. An automated sliding window mechanism includes a motor attached to a first component of a sliding window and configured to open and close the sliding window, a controller that controls the motor, and at least two air pressure sensors in communication with a processor. If the window is open, based on signals from the air pressure sensors, the processor determines whether a draft is flowing through the window. If the window is closed, based on signals from the air pressure sensor, the processor determines whether a draft would flow through the window if opened. The processor sends a signal to the controller to either open or close the window, depending on whether a user has elected to have a draft flow through the window. In a preferred embodiment, a system is provided with at least two automated windows.

18 Claims, 6 Drawing Sheets

(56) References Cited

U.S. PATENT DOCUMENTS 5,533,391 A * 7/1996 Brade ..... G01N 27/048 29/595
5,956,903 A * 9/1999 Parker ..... E04H 9/14 52/1
6,699,120 B1 * 3/2004 Darum ..... F24F 11/0001 454/239
7,114,389 B1 * 10/2006 Mouridsen ..... E05F 15/71 73/170.17
7,127,850 B1 * 10/2006 Fex, Jr. ..... F24F 11/0001 52/1
9,038,317 B2 * 5/2015 Hansen ..... E05F 15/665 49/360
9,382,747 B1 * 7/2016 Anderson ..... H04L 12/2803
9,483,933 B1 * 11/2016 Anderson ..... H04L 12/2803
9,500,383 B2 * 11/2016 Jensen ..... F24F 11/0001
2003/0024167 A1 * 2/2003 Cheng ..... E06B 3/4423 49/374
2005/0034374 A1 * 2/2005 Ebbe ..... G07C 9/00309 49/325
2006/0150520 A1 * 7/2006 Hamazaki ..... E05B 65/08 49/449
2008/0302015 A1 * 12/2008 Thorne ..... E05F 15/63 49/70
2012/0144743 A1 * 6/2012 Piney ..... E04F 10/005 49/29
2014/0047768 A1 * 2/2014 Vaknin ..... E05B 47/02 49/25
2015/0276238 A1 * 10/2015 Matsuoka ..... G05B 15/02 700/278
2016/0047158 A1 * 2/2016 Raap ..... E06B 3/44 49/31
2016/0069120 A1 * 3/2016 Hudepohl ..... E05F 1/002 49/21
2017/0101816 A1 * 4/2017 Kozonasky ..... E05F 15/635
2017/0175432 A1 * 6/2017 Dervitsiotis ..... G01W 1/00
2017/0205105 A1 * 7/2017 Adam ..... F24F 11/30
2018/0363356 A1 * 12/2018 Hohwart ..... E05F 15/635

* cited by examiner

AUTOMATED SLIDING WINDOW MECHANISM WITH AIR PRESSURE SENSOR

CROSS-REFERENCE TO RELATED APPLICATIONS

This application is a continuation in-part of U.S. patent application Ser. No. 15/945,935, filed Apr. 5, 2018 and entitled Gear-Driven Automated Window or Door System, which is, in turn, a continuation-in-part of U.S. patent application Ser. No. 15/867,431, filed Jan. 10, 2018 and entitled Motorized Gear Sliding Window or Door System, which is, in turn, a continuation-in-part of U.S. patent application Ser. No. 15/822,394, filed Nov. 27, 2017 and entitled Retrofittable Motorized Gear Sliding Window or Door System, which is, in turn, a continuation-in-part of U.S. Provisional Patent Application No. 62/528,288, filed Jul. 3, 2017 and entitled Retrofittable Motorized Gear Sliding Window The entire disclosures of which are incorporated herein by reference.

TECHNICAL FIELD

This invention relates generally to smart home devices and specifically to automated windows.

BACKGROUND

Many improvements and developments have been made in the field of Smart Home devices. However, many devices, especially existing devices in a residence or business (such as windows, window coverings and doors, for example), simply were not designed or configured to be smart.

Traditionally, windows are opened and closed manually for ventilation, energy or security or safety needs. For example, a window or door may be closed and locked while the owners are away from home to protect the home from entry by an intruder. A window or door may be opened in order to vent noxious gases from the interior of the home to the outside. When the inside of the house is hot, a door or window may be opened to allow cooler outside air to enter the house.

In order to enable these traditional functions to be carried out in an automated smart system, motorized devices are needed to open and close the windows or doors.

SUMMARY

In a first aspect, the disclosure provides an automated sliding window mechanism. An automated sliding window mechanism includes a motor attached to a first component of a sliding window and configured to open and close the sliding window, a controller that controls the motor, and at least two air pressure sensors in communication with a processor. If the window is open, based on signals from the air pressure sensors, the processor determines whether a draft is flowing through the window. If the window is closed, based on signals from the air pressure sensor, the processor determines whether a draft would flow through the window if opened. The processor sends a signal to the controller to either open or close the window, depending on whether a user has elected to have a draft flow through the window.

In a second aspect, the disclosure provides an automated sliding window mechanism wherein the user has pre-programmed his preferences for having a draft flow or not flow through the window and wherein the processor sends window opening and window closing signals automatically according to those pre-programmed preferences. The user may override their pre-programmed preferences. Furthermore, a user may override the pre-programmed preferences through a smart device.

In a third aspect, the processor provides the user with real-time information on whether a draft will flow or not flow through the window. In another embodiment, the processor provides the user with real-time information on whether a draft will flow or not flow through the window via a smart device, such as a smart phone or tablet.

In a fourth aspect, the processor provides at least two temperature sensors in communication with the processor, whereby the processor can determine the temperature effect of opening the window if closed or the temperature effect of closing the window if open. Additionally, one of the at least two pressure sensors is located outside the sliding window and another of the at least two pressure sensors is located inside the sliding window.

In a fifth aspect, a system for opening and closing at least two sliding windows is disclosed including a first motor attached to a first component of a first sliding window and configured to open and close the first sliding window, a first controller that controls the first motor, a second motor attached to a first component of a second sliding window and configured to move the second sliding window between a closed position and an open position, a second controller that controls the second motor, at least two air pressure sensors in communication with a processor, wherein, if both the first and second windows are currently open and based on signals from the air pressure sensors, the processor determines whether a draft is currently flowing in through one of the first and second windows and out the other of the first and second windows. Furthermore, the user may pre-program his preferences for having a draft flow or not flow through the first window and second window. The processor then sends window opening and window closing signals automatically according to those pre-programmed preferences.

In a sixth aspect, wherein there are at least two sliding windows, the user has pre-programmed his preferences for having a draft flow or not flow through the first window and second window and wherein the processor sends window opening and window closing signals automatically according to those pre-programmed preferences.

Further aspects and embodiments are provided in the foregoing drawings, detailed description and claims.

BRIEF DESCRIPTION OF THE DRAWINGS

The following drawings are provided to illustrate certain embodiments described herein. The drawings are merely illustrative, and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

Figure 1:
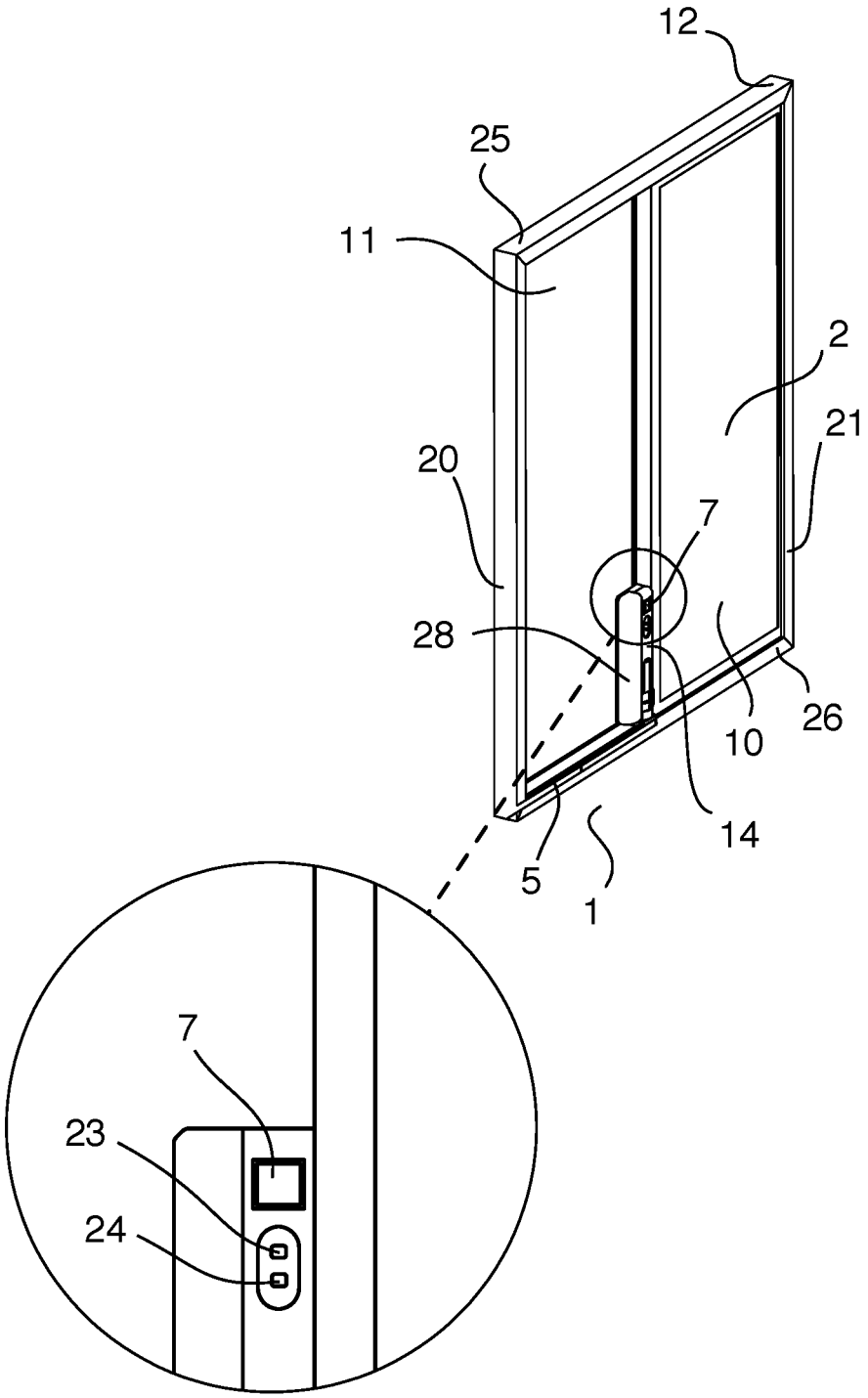
FIG. 1 is a perspective view of the automated sliding window mechanism with air pressure sensor.

The following description recites various aspects and embodiments of the inventions disclosed herein. No particular embodiment is intended to define the scope of the invention. Rather, the embodiments provide non-limiting examples of various compositions, and methods that are included within the scope of the claimed inventions. The description is to be read from the perspective of one of ordinary skill in the art. Therefore, information that is well known to the ordinarily skilled artisan is not necessarily included.

Definitions

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure, and are not meant to be limiting in any fashion. Nor do these phrases indicate any kind of preference for the disclosed embodiment.

As used herein, "draft" is meant to refer to a current of air either indoors or outdoors.

There are several reasons for which an individual might wish to have a draft blow into a building through a window—which building may be a home, an office building, a doctor's office, or a school. For example, during summer, many areas become extremely warm. A draft helps to cool down a building. Additionally, many people use air conditioners to cool, that is lower the temperature, of a building. However, air conditioning can be very expensive, and, whenever possible, many individuals wish to cool an area alternatively. Opening windows to allow for a draft to enter a building is one way of cooling an area. In addition to providing a cooling effect, a draft may be pleasant and provide fresh air wherein a building or room has become congested or stuffy. A draft can also help to alleviate strong or unpleasant odors which may be in a building or room. Because a draft helps to cool a room, reduce the expense of using air conditioning to cool a room, revive or freshen the air in a room, and alleviate unpleasant odors, many individuals choose to open their windows to allow a draft to pass through. However, it is often the case that a draft occurs when a user is not in a building, or when an individual is sleeping or otherwise occupied. Additionally, when an individual is inside a building, it is difficult or sometimes impossible to know if there is a draft outdoors. Furthermore, an individual may wish to open or close a window when there is a draft but be busy with work or a task, and find it inconvenient or impossible to leave their work or task to open or close a window. For these reasons, it useful and beneficial to have a window automated such that it can open or close a window when there is a draft.

In other circumstances, such as during the winter time, it is often very cold in certain areas. Despite this, individuals may wish to open their windows for the sake of allowing fresh air into a building. However, if a strong or violent draft occurs, an individual would likely determine that they want the window closed. For this reason, again, it is helpful to automate the opening and closing of a window based on whether or not there is a draft.

An automated sliding window mechanism comprises a motor, a controller, and at least two air pressure sensors. A sliding window is comprised of several components. Firstly, a frame which provides structure and is attached to the other components. The frame comprises a first vertical member and a second vertical member, as well as a first and second horizontal member. Secondly, a stationary component such as a first pane composed of glass or plastic and thirdly a sliding component such as a second pane composed of glass or plastic, both of which are disposed within the frame. Additionally, a channel through which the sliding component slides is attached to the frame. The components of a sliding window may be arranged such that the sliding component moves horizontally or vertically. For example, in one embodiment, the sliding component slides from a lower position to an upper position, or from an upper position to a lower position. As such, the channels allowing the sliding component to slide are positioned in a first vertical member and second vertical member. Alternatively, the sliding component slides from a first side to a second side, such as a left position to a right position, or a right position to a left position, and the channels are situated in the first and second horizontal members of the frame.

In one embodiment, the air pressure sensor is a barometer. In another embodiment, the air pressure sensor is an electronic pressure sensor.

The automated sliding widow mechanism may be programmed to operate according to a user's preferences. For example, a user may prefer that in the springtime, if a draft is flowing, the windows should open completely. Or, a user may prefer that the sliding window only opens halfway whenever a draft is flowing during spring. In another embodiment, a user prefers that during fall, the siding windows are open 25% when a draft is blowing, and that during winter, the windows open 50% between 9 am and 11 am as long as there is no draft.

Furthermore, in another embodiment, a user is able to override their pre-programmed preferences. For example, a user has programmed their preferences such that during the summer, the sliding window opens completely if a draft is present from the hours of 8 am to 9 am every day. However, if the user decides that one night is particularly cool, they can override the pre-programmed preference and tell the window to not open that night for a draft. In one example, a user creates and is able to override their programmed preferences via a smart device, such as a smart phone or tablet.

In another embodiment, the automated sliding window mechanism is equipped with a temperature sensor in addition to the pressure sensor. In this embodiment, a user may program preferences that combine the data of the pressure sensor and the temperature sensor. For example, in one embodiment, a user selects that during the month of May, the window should open 75% whenever there is a draft if the outdoor temperature, that is the temperature outside of the building, is above 70 degrees. In another embodiment, wherein the automated sliding window mechanism is equipped with a temperature sensor, a user programs their preferences such that if the internal temperature, that is the temperature inside the building, is above 75 degrees, then the sliding window should open, regardless of whether or not there is a draft. However, in another embodiment, a user programs their preferences such that if the internal temperature is above 75 degrees, the sliding window will open only if there is a draft.

There are various types of temperature sensors. The temperature sensor included in the automated sliding window mechanism may be a negative temperature coefficient thermistor, a resistance temperature detector, a thermocouple, or a semiconductor based sensor.

In another embodiment, the automated sliding window mechanism is equipped to receive weather information from an online weather source and uses that data to determine what information to send to the user and to determine whether to send signals to open or close the window. For example, an online weather source indicates that there will be a rainstorm at 5 pm until 7 pm. A user sets their window to open at 5 pm and remain open until 10 pm wherein the outside temperature is between 60 and 75 degrees. However, upon receiving this information from the online weather source, the automated sliding window mechanism overrides the user's pre-programmed preferences, and keeps the window closed until 7 pm. The automated sliding window mechanism also sends a notification to the user at the time it receives the data from the online weather source, indicating that their pre-programmed preferences will be overridden because of the data received from the online weather source indicating that a rainstorm will occur. At that point, a user can choose to allow the automated sliding window mechanism to override their preferences, or indicate that in spite of the online weather source's data, the windows should open and close at their usual time.

Furthermore, in one embodiment, the temperature sensor calculates the temperature effect of opening or closing a sliding window. For example, a user programs their preferences such that the room of the building in which the automated sliding window mechanism is placed should be between 65 degrees and 75 degrees during the spring months. When the temperature sensor senses that the indoor temperature has risen above 75 degrees, it determines that by completely opening the window, the temperature in the room will fall 4 degrees, which would put the room in the acceptable temperature range. Therefore, the automated sliding window mechanism opens the sliding window. After a time, the temperature sensor senses that the room temperature is at 64 degrees, and that by closing the window, the temperature will rise 5 degrees. As such, the automated sliding window mechanism closes the sliding window. In doing so, the temperature sensor is able to keep the room temperature within a range that a user has pre-selected.

It may be useful for a user to know in real-time whether or not a draft will flow through the window. For example, a user may have felt particularly warm one day during the winter, and wish to override their pre-programmed preferences to keep the windows shut knowing that there is a draft that will flow through the window. In a preferred embodiment, this information is provided to the user via a smart device such as a smart phone. Furthermore, a user may be interested in knowing at what time of day the most drafts occur, and then program their automated sliding window mechanism to open their window during those hours.

In another embodiment, at least two automated sliding window mechanisms are located within one building, wherein each automated sliding window mechanism comprises a motor, a controller, a processor, and at least one air pressure sensor. In one example, a user has installed one automated sliding window mechanism on a first window in a living room, and a second automated sliding window mechanism on a second window in a living room, wherein the first window and second window face one another. The user has set their preferences such that if a draft will blow through the first window, it should open, but the second window should not open. Or, alternatively, if a draft will flow through the second window, the first window, if open, should close, but if it is closed, should remain closed. This would allow a draft to enter the living room and cool it down. In another embodiment, the user prefers that if a draft will flow through either the first or second window in the living room, the window through which the draft did not enter should also open, thus allowing the draft to enter one window and exit the other. Doing so may provide a pleasant breeze in the living room, and may also cool the room.

Wherein at least two automated sliding window mechanisms are located within one building, they may each be equipped with at least two temperature sensors. Furthermore, the automated sliding window mechanisms may exchange air pressure information and temperature sensor information to achieve the pre-programmed preferences of a user. For example, a user has set their preferences such that the living room temperature in their home during the summer should be between 72 degrees and 80 degrees. The first and second automated sliding window mechanisms detect via their indoor temperature sensors that the living room temperature is 82 degrees. The first automated sliding window mechanism determines that by fully opening the window to which it is attached, the internal room temperature will drop by one degree. The first automated sliding window mechanism then communicates this information to the second automated sliding window mechanism, which second automated sliding window mechanism determines that a draft will flow through it when opened, and further decrease the internal room temperature by 3 degrees if opened. As such, the second automated sliding window mechanism also opens the window to which it is attached. As such, the internal room temperature lowers to 78 degrees—a temperature within the pre-programmed preferences of the user.

Furthermore, a user may pre-program their preferences such that during the summer, if there is a draft that will flow through the first or second automated sliding window mechanism, it should open, regardless of the time of day. In another embodiment, a user may program their preferences such that if a draft will flow through a window, the automated sliding window mechanism should open, and then remain open for a period of time after the draft has stopped flowing through the window, such as for 5 minutes or 30 minutes, or 1 hour.

In another embodiment, a user has between 6 and 10 automated sliding window mechanisms located within a building—preferably one attached to each window in the building. In this embodiment, the processors of each automated sliding window mechanism exchange air pressure sensor information and temperature sensor information. A user can program the preferences of each automated sliding window mechanism separately, such that the automated sliding window mechanism in a first bedroom opens between the hours of 8 am and 4 pm if a draft will flow through the window, but the automated sliding window mechanism in a second bedroom only opens if a draft will flow through the window when the external temperature is below 75 degrees. Furthermore, all the automated sliding window mechanisms throughout the building are programmed such that together, they should try to achieve an internal temperature of 71 degrees. In the first bedroom, the automated sliding window mechanism has opened the window, but the temperature is still at 74 degrees. The processor of the automated sliding window mechanism in the first bedroom sends this information to the processor of the automated sliding window mechanism in the living room. The automated sliding window mechanism in the living room senses an internal temperature of 69 degrees, but keeps the window open to try and cool the first bedroom where the internal temperature is too high.

In another example, an automated sliding window mechanism in a first bedroom senses that the external temperature is 85 degrees, and although the internal temperature is higher than what a user has selected as their preference, it is lower than 85 degrees and as such, the automated sliding window mechanism does not open the window to which it is attached.

In one embodiment, the automated sliding window mechanism opens and closes the sliding window with a rack and gear. The rack teeth mesh with the gear which is powered by the motor to pull the sliding window to an open position, wherein the sliding component is fully or partially overlapping the stationary component, or to push the sliding window into a closed position, wherein the sliding component and the stationary component do not overlap. The opening and closing of the sliding window is accomplished as the gear walks along the rack. The gear that meshes with the rack may be a spur gear, helical gear, or worm gear.

Alternatively, the automated sliding window mechanism opens and closes the sliding window by means of a first pulley wheel affixed to and driven by a first motor. There may also be a second pulley wheel attached to a second vertical member of the frame along with a first linear flexible material, such as a rubber band, wherein the first linear flexible material forms a continuous belt that wraps around the first pulley wheel and the second pulley wheel, and wherein the first linear flexible material is attached in at least one location to the first horizontal member of the sliding component. When the motor drives the first pulley wheel in a first direction, it may cause the first pulley wheel to pull on the linear flexible material such that the sliding component slides towards the first vertical member. Driving the first pulley wheel in a second direction may cause the first pulley wheel to pull on the linear flexible material such that the slidable segment slides towards the second vertical member. The first and second directions may be vertical or horizontal.

The automated sliding window mechanism is controlled by a controller. In a preferred embodiment, the controller is a smart phone running an app. Alternatively, the controller is buttons on the motor assembly, which includes the motor.

Furthermore, in a preferred embodiment, the automated sliding window mechanism includes a moisture sensor placed outside the window for detecting moisture. When moisture is detected at or near the window to which the automated sliding window mechanism is attached, the processor overrides any pre-programmed preferences to open the window. And, wherein a window is open, and the moisture sensor senses moisture, the window will close. There are many instances in which this feature may be helpful. For example, a user may have programmed their preferences such that during the month of July, windows should open whenever there is a draft, so long as the outside temperature is below 75 degrees and above 60 degrees. However, if there is a summer thunderstorm, perhaps when a user is not in the building wherein the automated sliding window mechanism is located, water could enter the building. Or, in another example, a sprinkler is running during the night, and a user has programmed their preferences such that their windows should remain open from 8 pm until 8 am. Upon sensing moisture, the moisture sensor would close the window, overriding the user's preferences to protect the inside of the building from water damage. When the automated sliding window mechanism senses moisture and overrides the user's pre-programmed preferences, the user will receive a notification via the controller, preferably a smart phone, that their preferences are being overridden. At that time, a user can indicate to the automated sliding window mechanism that it should not override their pre-programmed preferences if that is what the user prefers.

Now referring to FIG. 1, the automated sliding window mechanism 1 is shown. A sliding window 2 is attached to the automated sliding window mechanism 1. The sliding window 2 is composed of several parts. It comprises a sliding component 10, such as a glass pane, and a stationary component 11, such as a glass pane, mounted in a frame 12. The frame 12 consists of two vertical members, a first vertical member 20 and a second vertical member 21, as well as two horizontal members, a first horizontal member 25 and a second horizontal member 26. The sliding window 2 may be in an open position, wherein the sliding component 10 is fully or partially overlapping the stationary component 11, or push the sliding window 2 into a closed position, wherein the sliding component 10 and the stationary component 11 do not overlap. In this embodiment, the opening and closing of the sliding window 2 is accomplished as the gear in the gear assembly 14 walks along the rack 5. In this embodiment, the rack 5 is facing the sliding window 2, in particular, the rack 5 is facing the stationary component 11 of the sliding window 2. In another embodiment, the rack 5 is attached to the outside of the window channel, such that the rack 5 faces the room or building in which the sliding window 2 is located. Additionally, the rack 5 may be attached to the stationary component 11, and the motor assembly 14, consisting of the motor and the gear, may be attached to the sliding component 10. Alternatively, the rack 5 is attached to the sliding component 10 and the motor assembly 14 is attached to the fixed component 11.

The gear assembly 14 also includes an internal sensor 7. In a preferred embodiment, the internal sensor 7 is a temperature sensor and an air pressure sensor. However, in another embodiment, the internal sensor 7 is only a temperature sensor, and the air pressure sensor is not attached to the gear assembly 14. In yet another embodiment, the internal sensor 7 is an air pressure sensor but not a temperature sensor, and the temperature sensor is not attached to the gear assembly 14. Alternatively, the internal sensor 7 is an air pressure sensor, and the temperature sensor is located elsewhere on the gear assembly 14. In another embodiment, the internal sensor 7 is a temperature sensor and the air pressure sensor is located elsewhere on the gear assembly 14.

Figure 2:
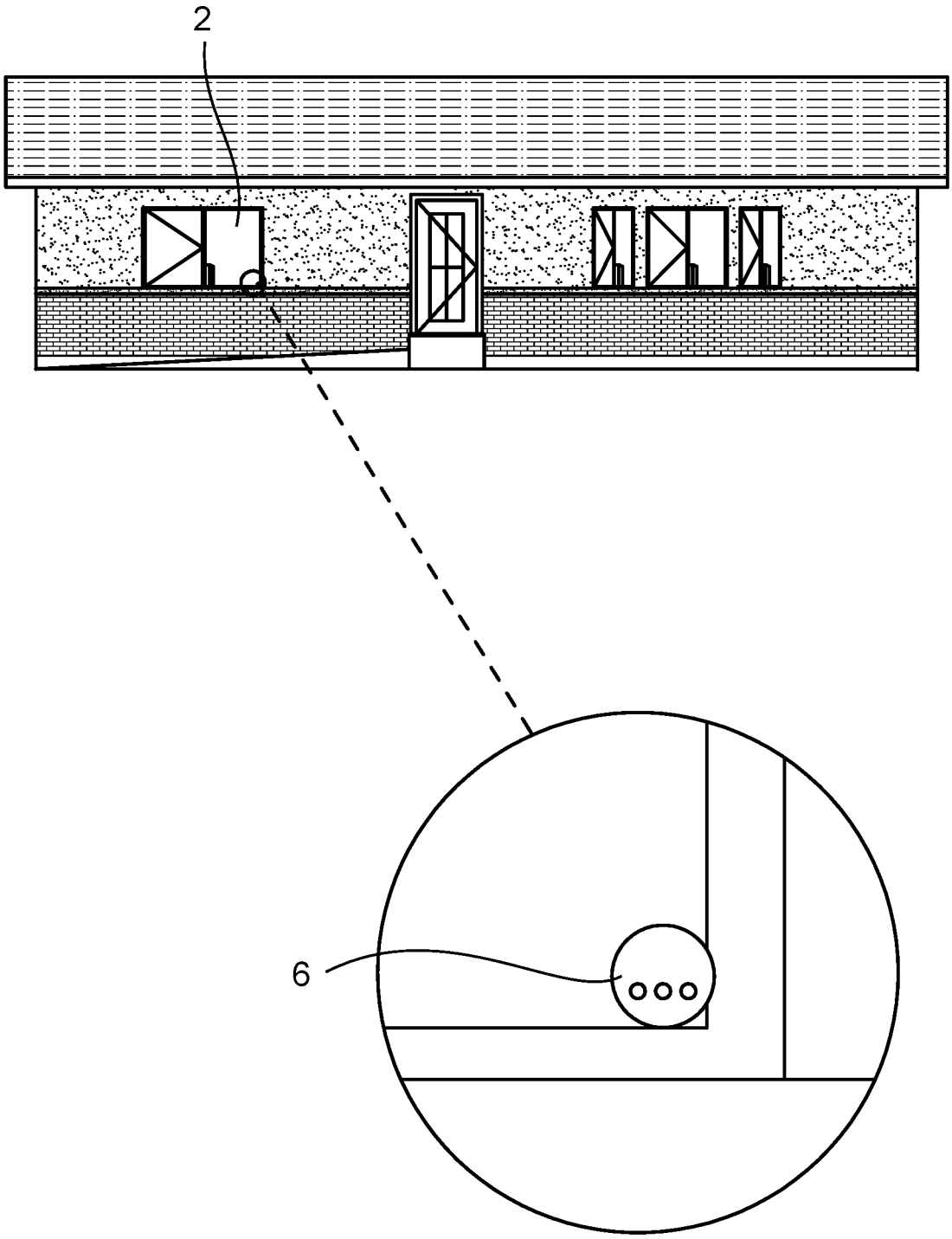
FIG. 2 is a front view of a building with the automated sliding window mechanism attached to a sliding window and an air pressure sensor attached to the sliding window.

FIG. 2 a front view of a building with the automated sliding window mechanism 1 attached to a sliding window 2 and an air pressure sensor attached to the sliding window. In this embodiment, an external sensor 6 is placed at the corner of the window. However, in another embodiment, the external sensor 6 is placed on the roof of a building, or by the front door. Preferably, the external sensor 6 is an air pressure sensor, a temperature sensor, and a moisture sensor. Alternatively, the external sensor 6 is an air pressure sensor, and the temperature sensor and moisture sensors are located elsewhere. In another embodiment, the external sensor 6 is a temperature sensor and air pressure sensor and the moisture sensor is located elsewhere. In another embodiment, the external sensor 6 is a temperature sensor and the air pressure sensor and moisture sensor are located elsewhere.

Figure 3:
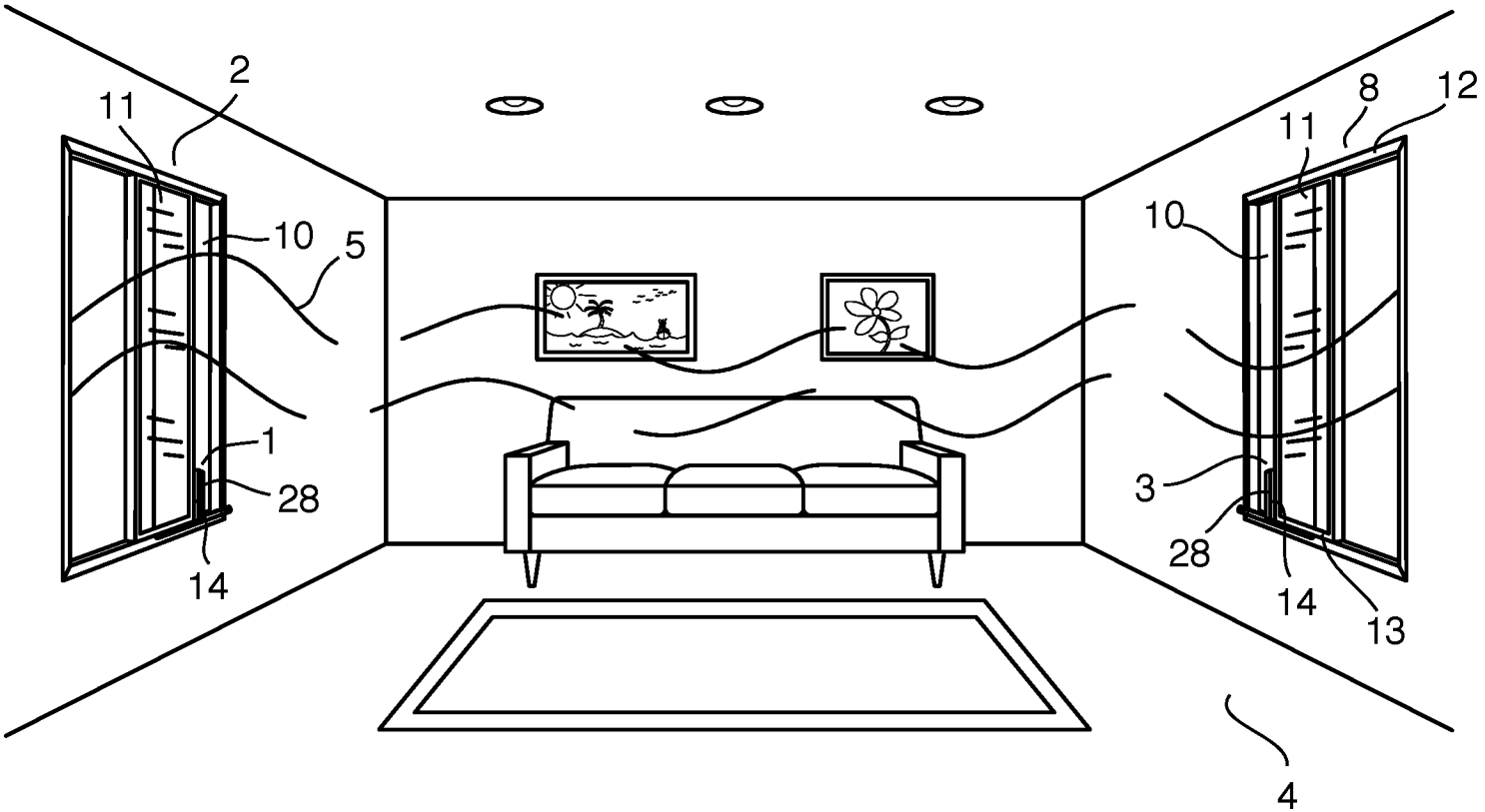
FIG. 3 is a perspective view of a room in a building with two automated sliding window mechanisms.

FIG. 3 is a perspective view of a room in a building with two automated sliding window mechanisms. A first sliding window 2 is in an open position, such that a draft 5 flows through the sliding window 2. A second sliding window 8 is also in an open position, such that as the draft 5 flows through the first sliding window 2, it moves through the room and out the second sliding window 8. In this example, a user sets their preferences such that the first sliding window 2 should be opened 80% if a draft is blowing and the external temperature is below 75 degrees. In response, the second sliding window 8 should open 80% when it senses an internal draft—which is created by the draft 5 flowing through the first sliding window 2. Furthermore, in another example, a user is familiar with the region in which the building is located wherein one or more automated sliding window mechanisms are installed. As such, the user knows that typically speaking, in their region, drafts tend to blow from west to east. In this embodiment, the first sliding window 2 is placed on the west side of the building, and the second sliding window 8 is placed on the east side of the building. The user then programs their preferences such that should the external sensor 6 on the first sliding window 2 sense a draft, it should always open, and the external sensor 6 on the second sliding window 8 should not open wherein a draft is present. However, the internal sensor 7 on the second sliding window 8 should open when it senses a draft.

Figure 4:
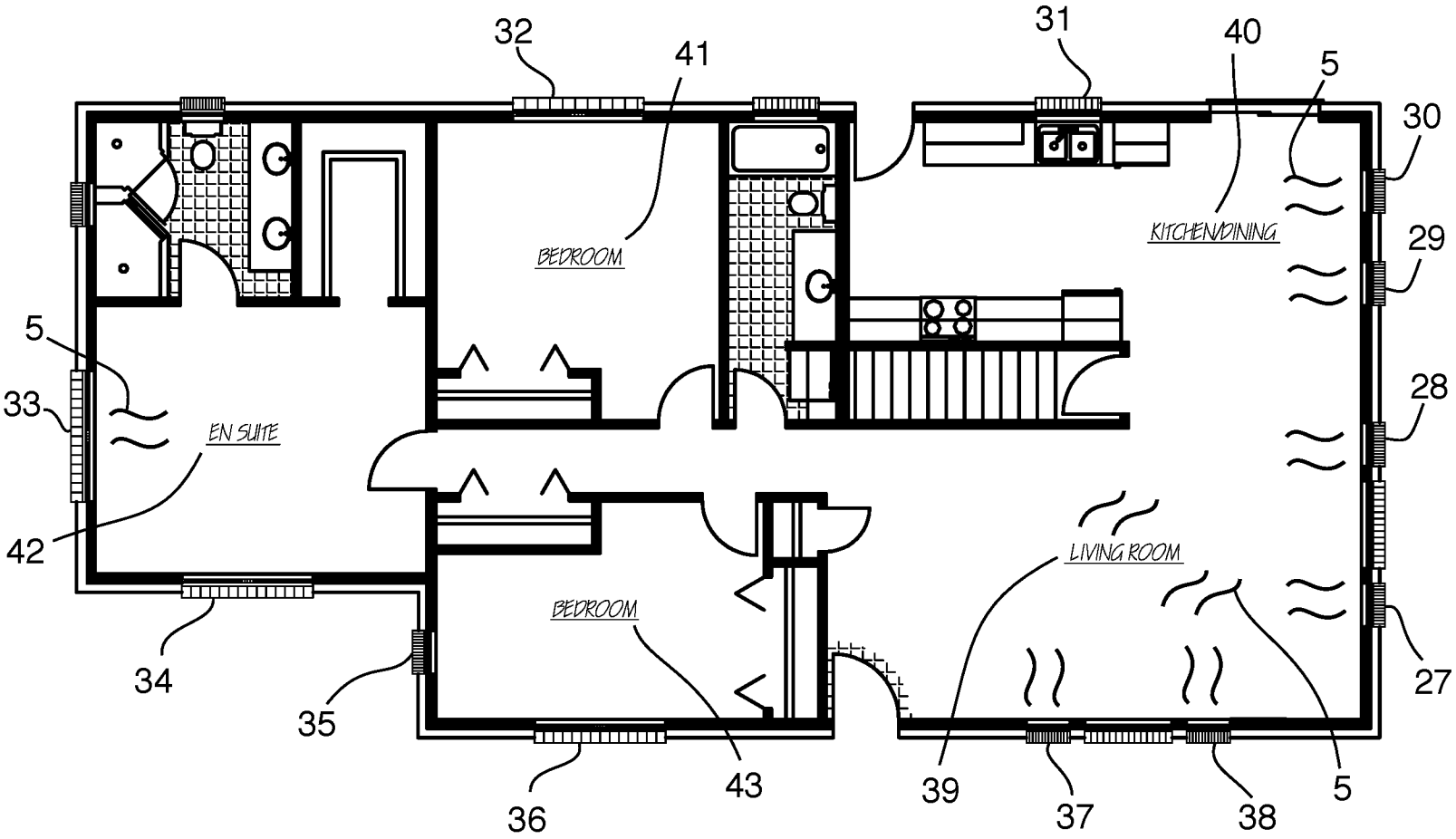
FIG. 4 depicts a floor plan of a house, wherein there are several automated sliding window mechanisms.

FIG. 4 is a floor plan of a house, wherein there are 12 automated sliding window mechanisms. Each automated sliding window mechanism may be programed to have different preferences. Or, a user may organize the windows by room. Or, a user may organize the windows by region of the house. For example, a user programs the windows of bedrooms 41, 42, and 43 to open at 7 pm and close at 11 pm if there is a draft and if the temperature is above 60 degrees and below 80 degrees. The user also programs joint living area windows, including the windows in the kitchen 40 and the windows in the living room 39 to open at 6 am and close at 11 am, if a draft is not blowing and if the temperature is above 60 degrees and below 75 degrees. Or, a user may set every window with the same preferences. For example, in springtime, all windows open at 7 am and close at 12 pm if a draft is flowing, regardless of temperature.

Figure 5:
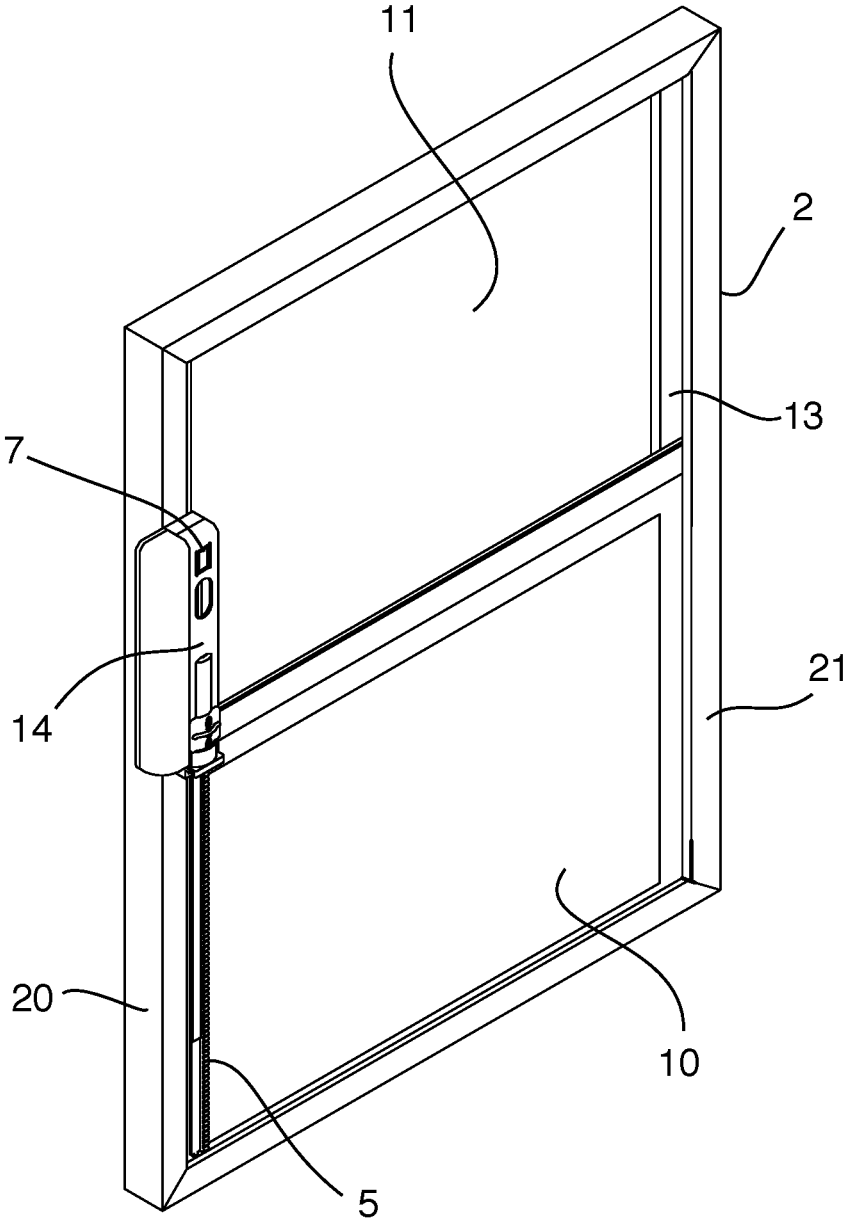
FIG. 5 is a perspective view of a sliding window wherein the sliding component slides from a lower position to an upper position.

FIG. 5 is a perspective view of a sliding window wherein the sliding component slides from a lower position to an upper position. In this embodiment, the sliding component 10 is in the lower position, that is, positioned below the stationary component 11, and the sliding window 2 is closed. Additionally, in this embodiment, the rack 5 is attached to the sliding component 10 and the motor assembly 14 is attached to the first vertical member 20 of the frame 12. In another embodiment, the motor assembly 14 is attached to the second vertical member 21 of the frame 12. In yet another embodiment, the rack 5 is attached to the outside of the window channel 13. The rack 5 may be attached to the inside of the window channel 13 such that the rack 5 faces towards the stationary component 11. However, in another embodiment, the rack 5 is attached to the outside of the window channel 13 such that the rack 5 does not face the sliding window 2.

Figure 6:
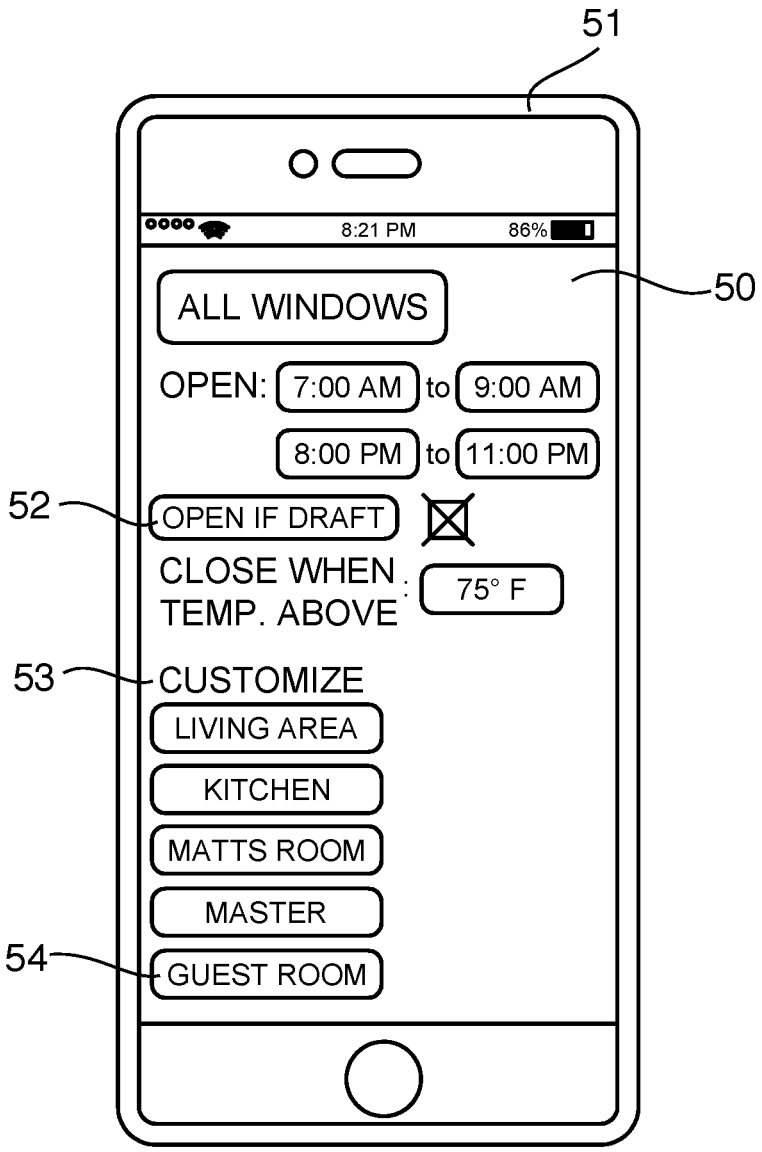
FIG. 6 shows a graphical user interface for setting up and automating the automated sliding window mechanism in different rooms or spaces.

FIG. 6 shows a graphical user interface 50 on a smart phone 51 for setting up and automating the automated sliding window mechanism 1 in different rooms or spaces. In this embodiment, the graphical user interface 50 is designed such that a user can set preferences for all windows and has selected that all windows should open at 7 am and close at 9 am, and then open again at 8 pm and close at 11 pm. The user has indicated that a window should open if a draft is flowing by selecting the "open if draft" button 52, and that windows should automatically close if the external temperature is above 75 degrees Fahrenheit. Furthermore, a section entitled "Customize" 53 allows a user to select a single window from the group of windows in the building equipped with automated sliding window mechanisms and to make adjustments to that selected window. For example, during the winter, a user likes to open windows in bedrooms and common living areas occasionally to have some fresh air. However, to keep heating bills down, the user opts to keep the guest room windows closed almost always during winter. This is accomplished by selecting the "guest room" button 54 wherein the user can select that window should be kept closed, regardless of drafts or temperature.

Furthermore, there may be situations wherein a user would like to open or close the window using physical buttons on the automated sliding window mechanism 1. This may occur when, for example, the controller is a user's smart phone and their smart phone has died. The motor assembly 14 comprises two buttons that allow a user to manually open or close the sliding window 2. A first button 23 moves the sliding component 10 to an open position, and a second button 24 moves the sliding component 10 to a closed position. In other embodiments, pressing the button 23 quickly fully opens the sliding component 10, while holding the first button 23 causes the sliding component 10 to open incrementally. Alternatively, rapidly pressing the closing button 24 causes the sliding component 10 to shut completely, while holding the closing button 24 causes the sliding component 10 to close incrementally.

Due to the placement of automated windows at or near windows, an automated window in accordance with the invention may also advantageously include security sensors to monitor security at or near a window. In one embodiment, the security sensor is a proximity sensor configured to detect opening and/or closing of a window or door. In another embodiment, the security sensor is an impact sensor configured to detect impacts on and/or breakage of a window. For example, an accelerometer may act as an impact sensor to detect an extent of force on a window. Different alerts or notifications may be sent to a user or other entity depending on the extent of the impact. For example, touching a window may trigger a low priority alert or notification. Larger forces (causing a window to break, for example) may trigger higher priority alerts or notifications. In some embodiments, high priority alerts may be configured to trigger gathering of camera footage at or near a window.

In another embodiment, the security sensor is a camera configured to gather video or still shots at or around a window. In certain embodiments, an LED or other lighting may be provided for recording video or still shots in low lighting conditions. The video or still shots may be streamed wirelessly to a centralized security system or stored on a motorized gearbox assembly for later retrieval. In other embodiments, the security sensor is a motion sensor configured to detect motion at or around a window. In yet other embodiments, the security sensor is an audio sensor configured to collect audio at or around a window. By incorporating security sensors into automated windows, security may be monitored at each window. In certain embodiments, information from the security sensors is relayed to a centralized security system. In other embodiments, an automated window in accordance with the invention may be configured to act as a centralized security system by gathering information from security sensors located at various automated windows. Such a centralized security system may, in certain embodiments, send notifications to a user, smart device, security company, law enforcement office, or the like, when breaches of security are detected.

The sensors may also, in certain embodiments, include safety sensors such as smoke detectors, carbon monoxide sensors, or the like. Outfitting automated windows with such sensors may provide a large number of sensors at prime locations throughout a home or business, while at the same time eliminating or reducing the need to equip a home or business with separate independent sensors. In certain embodiments, alerts or notifications may be sent to a user or first responder when smoke, carbon monoxide, or other critical substances or gases have been detected.

A current/voltage sensor may be provided to sense current or voltage associated with the motors or actuators. In certain embodiments, this information may be used to ensure that a motor or actuator is not overloaded. The current/voltage may also be used to calibrate the automated window. For example, when the automated window is fully closed (i.e., have reached their maximum position), the current of the motor or actuator may spike in response to their non-movement. This spike in current may indicate that a maximum position has been reached. The position of the window may be recorded at this point (using the position encoder) to remember the maximum position. The automated window may then be moved in the opposite direction until they stop (i.e., reach their minimum or fully open position). The current of the motor or actuator may again spike in response to the non-movement of the window. This spike may indicate that a minimum position has been reached. The minimum position may be recorded. In this way, the current/voltage sensor may be used in conjunction with the position encoder to learn the range of motion and stopping points of the motorized window. In certain embodiments, this calibration technique may be performed when the automated window is initially powered up or installed. Once the calibration is performed, the motorized window may, through various calculations, move the window to any desired position between the stopping points. The current/voltage sensor may, along with the position encoder, be used to estimate a size of an automated window. Knowing the size of the automated window may be used to prevent over-torqueing of the motorized window mechanisms.

An automated window in accordance with the invention may also be configured to interface with external sensors. Although various sensors (as previously discussed) may be located in the automated window or in close proximity to the automated window, other sensors may be located external to the automated window and, in some cases, be far removed from the automated window. For example, a temperature sensor located in one part of a building may be used to trigger operation of automated windows in other parts of the building. In other cases, readings from multiple sensors located throughout a building may be used to influence operation of an automated window or a group of automated windows. In certain cases, data may be gathered from external sensors and wirelessly communicated to an automated window or group of automated windows.

As previously mentioned, an automated window or group of automated windows in accordance with the invention may also be controlled (e.g., wirelessly controlled) by external switches, such as a remote control or a specialized wall switch. These switches may provide additional mechanisms for controlling an automated window or group of automated windows. In certain cases, a wall switch or remote control may provide a faster and more convenient way to control an automated window or group of automated windows than an application. In certain embodiments, an external switch in accordance with the invention may provide functionality to control devices other than automated windows.

In some embodiments, the frame has a latching device that mates to a latching receiver attached to the sliding component 10, wherein mating prevents movement of the sliding component. In some embodiments, the latching receiver comprises a communication device that generates a signal when the latching device is mated and transmits that signal to the motor, wherein the signal deactivates the motor.

In an embodiment, the controller sends control signals to the device to operate in such a way to assure the safety of occupants in the building wherein the automated sliding window mechanism is located. For example, CO detectors or smoke detectors may open windows upon detection of noxious gases. Ventilation fans at or near the window opening may also be turned on to actively promote the ventilation of these gases. Other safety embodiments include closing all windows when air quality alerts indicate that exterior air is not healthy (red zone). This info may be relayed to the controller via the cloud-based network or from sensors. In an embodiment, the controller may close all windows when high winds are in the area. This info may be determined by exterior sensors or weather reports via a cloud-based network.

In an energy embodiment, the controller may tie in with the building HVAC system in order to allow the HVAC system to open windows to let in cool air when the interior space is too hot. This allows the HVAC system to operate in an economizer mode when outdoor air temperature is cool so that the air conditioner does not have to be operated. This saves energy. Temperature sensors inside the building and outside of the building inform the controller. The fan of the HVAC system may be activated to draw air in through the open window (creating a negative air pressure within the building).

In an embodiment, exterior humidity or moisture sensors may inform the controller that rain or a water from sprinkler system is near a window opening. The controller may then close windows that are open that may be impacted by the water intrusion. Weather reports from an online service may also inform the controller to enable this operation.

In another embodiment, sensors may be located inside or outside of the building at locations near the window or far away. These sensors may inform the controller regarding conditions that impact the operation of the device. For example, temperatures at or near the window may be different than the outdoor temperature or the temperature in other parts of the building. Decisions regarding the opening and closing of a window may depend on not only the temperature at the window, but also other locations inside and outside of the building.

A light sensor may sense light levels at or around a window. Various types of light sensors, including photovoltaic cells, cameras, photo diodes, proximity light sensor, or the like, may be used depending on the application. In an embodiment, the solar panel may be used as a light sensor. In certain embodiments, a light sensor may sense light external to a window. This may allow an automated window to open or close or increase and decrease opacity in response to lighting conditions outside a building. For example, an automated window may be configured to open at sunrise and close at sunset. Alternatively, or additionally, an automated window may be configured to open (either fully or partially) when conditions are overcast, thereby letting more light into a room or space, and close (either fully or partially) in response to detecting full sunlight, thereby letting less light into a room or space. In certain embodiments, a light sensor may be used to determine a total amount of light energy entering a room or space through a window. This information may be used to adjust an automated window or to adjust HVAC system parameters. In another embodiment, the window may be closed upon detection of water or moisture from an environmental sensor.

A light sensor may also be configured to sense light levels internal to a window, such as within a room or interior space. This may allow an automated window to be adjusted based on interior light levels. For example, an automated window may be opened in response to lower levels of interior light and closed in response to higher levels of interior light. In certain embodiments, various algorithms may be used to adjust automated windows in response to both exterior and interior light levels, as opposed to just one or the other. Thus, in certain embodiments light sensors may be provided to sense both exterior and interior light levels.

In certain embodiments, the opening and closing of automated windows may be coordinated with the turning on or off of lights in a room or space. For example, if lights in a room are turned off, automated windows may be opened to compensate for the reduced amount of light. This allows natural light to replace artificial light and creates opportunities for conserving energy. In certain embodiments, lights may be automatically turned off and automated windows may be automatically opened to replace artificial light with natural light when conditions allow. In such embodiments, the automated windows and interior lighting may be controlled by a home automation platform or other controller to provide desired amounts of light in a room or space while simultaneously conserving energy.

All patents and published patent applications referred to herein are incorporated herein by reference. The invention has been described with reference to various specific and preferred embodiments and techniques. Nevertheless, it understood that many variations and modifications may be made while remaining within the spirit and scope of the invention.

What is claimed is:

1. An automated sliding window mechanism comprising:

a motor retrofittably mounted to a surface of a first component of a sliding window and configured to open and dose the sliding window;

a controller that controls the motor, and;

at least two air pressure sensors in communication with a processor, wherein at least one of the air pressure sensors is an external sensor;

wherein at least one of the air pressure sensors is an internal sensor;

wherein, if the window is currently open and based on signals from the air pressure sensors, the processor determines whether a draft is currently flowing through the window;

wherein, if the window is currently dosed and based on signals from the air pressure sensors, the processor determines whether a draft would flow through the window if opened;

wherein the processor sends a signal to the controller to either open or close the window depending on whether a user has elected to have a draft flow through the window;

wherein the external sensor is retrofittably attached to an outside surface of the sliding window; and wherein the internal sensor is retrofittably attached to an interior surface of the sliding window.

2. The automated sliding window mechanism of claim 1, wherein the user has pre-programmed his preferences for having a draft flow or not flow through the window and wherein the processor sends window opening and window closing signals automatically according to those pre-programmed preferences.

3. The automated sliding window mechanism of claim 2 wherein the user has an option to override the pre-programmed preferences.

4. The automated sliding window mechanism of claim 3, wherein the user pre-programs his preferences for having a draft flow or not flow through the window and has an option to override the pre-programmed preferences all through a smart device.

5. The automated sliding window mechanism of claim 1, wherein the processor provides the user with real-time information on whether a draft will flow or not flow through the window.

6. The automated sliding window mechanism of claim 5 wherein the information is provided to a smart device.

7. The automated sliding window mechanism of claim 6 wherein the processor uses the signals from the at least two air pressure sensors to determine the strength of a draft if the window is opened and provide that information to the user through the smart device.

8. The automated sliding window mechanism of claim 7, wherein the user has pre-programmed his preferences for having a draft flow or not flow through the window and his preferences for temperature effects of opening or closing the window; and wherein the processor sends window opening and window closing signals automatically according to those pre-programmed preferences.

9. The automated sliding window mechanism of claim 1 further comprising at least two temperature sensors in communication with the processor, whereby the processor can determine a first temperature determined from opening the window or a second temperature determined from closing the window.

10. The automated sliding window mechanism of claim 1, further comprising a moisture sensor located outside the sliding window, and wherein the processor is configured to receive signals from the moisture sensor, to thereby detect precipitation outside the window and override any signal to open the window.

11. The automated sliding window mechanism of claim 1 wherein the processor is configured to receive data from an online weather source and uses that data to determine what information to send to the user and to determine whether to send signals to open or close the window.

12. A system for opening and closing at least two sliding windows comprising:

a first motor retrofittably mounted to a surface of a first component of a first sliding window and configured to open and close the first sliding window;

a first controller that controls the first motor;

a second motor retrofittably mounted to a surface of a first component of a second sliding window and configured to move the second sliding window between a closed position and an open position;

a second controller that controls the second motor;

at least two air pressure sensors in communication with a processor, wherein at least one of the air pressure sensors is an external sensor;

wherein at least one of the air pressure sensors is an internal sensor;

wherein, if both the first and second windows are currently open and based on signals from the air pressure sensors, the processor determines whether a draft is currently flowing in through one of the first and second windows and out the other of the first and second windows;

wherein, if one or both of the first and second windows are currently dosed and based on signals from the air pressure sensors, the processor determines whether a draft would flow in through one of the first and second windows and out through the other of the first and second windows if both windows were opened;

wherein the processor sends a signal to the first and second controllers to either open or close the first and second windows depending on whether a user has elected to have a draft flow through the windows;

wherein the external sensor is retrofittably attached to an outside surface of the first sliding window; and wherein the internal sensor is retrofittably attached to an inside surface of the first sliding window.

13. The system of claim 12, wherein the user has pre-programmed his preferences for having a draft flow or not flow through the first window and second window and wherein the processor sends window opening and window closing signals automatically according to those pre-programmed preferences.

14. The system of claim 13, wherein the user pre-programs his preferences for having a draft flow or not flow through the windows and has an option to override the pre-programmed preferences through a smart device.

15. The system of claim 12, wherein the processor uses the signals from the at least two air pressure sensors to determine the strength of a draft and provides the user with real-time information on a smart device on whether a draft will flow or not flow through the first sliding window and on the strength of the draft.

16. The system of claim 15, wherein the user has pre-programmed his preferences for having a draft flow or not flow through the windows and his preferences for temperature effects of opening or dosing the windows; and wherein the processor sends window opening and window dosing signals automatically according to those pre-programmed preferences.

17. The system of claim 12 wherein the processor is configured to receive data from an online weather source and uses that data to determine what information to send to the user and to determine whether to send signals to open or close the window.

18. A retrofit kit for automating a sliding window assembly with a frame and a slidable window, the kit comprising:

a rack retrofittably mounted to a surface of one of the frame or the slidable window;

a retrofit gearbox retrofittably mounted to a surface of the other of the frame or the slidable window, and wherein the retrofit gearbox comprises:

a motor configured to open and close the sliding window;

a processor;

a controller that controls the operation of the motor;

an air pressure sensor retrofittably mounted to a surface of the sliding window, the air pressure sensor being in communication with the processor;

at least one gear rotated by the motor;

wherein the gear mates with the rack;

wherein, based on signals received from the air pressure sensor and user preferences, the processor sends a signal to the controller to either open or close the window.

* * * * *